United States Patent [19]

Watts

[11] Patent Number: 4,769,156

[45] Date of Patent: Sep. 6, 1988

[54] METHOD AND MEANS TO PUMP A WELL

[76] Inventor: John D. Watts, 10700 NW. Freeway, Ste. 105, Houston, Tex. 77092

[21] Appl. No.: 890,185

[22] PCT Filed: Nov. 23, 1984

[86] PCT No.: PCT/US84/01935

§ 371 Date: Aug. 5, 1986

§ 102(e) Date: Aug. 5, 1986

[87] PCT Pub. No.: WO86/03250

PCT Pub. Date: Jun. 5, 1986

[51] Int. Cl.[4] ..... B01D 35/02

[52] U.S. Cl. ..... 210/744; 210/799; 210/137; 210/416.1; 210/258; 55/46; 55/171; 55/166; 166/267; 166/105.3

[58] Field of Search ..... 55/36, 45, 55, 171, 55/172, 166, 167; 166/105.3, 105.5, 229, 267, 269, 372, 313, 373, 267; 210/416.1, 137, 258, 744, 799; 60/453, 454

[56] References Cited

U.S. PATENT DOCUMENTS

| | | | |
|---|---|---|---|
| 1,269,134 | 6/1918 | Trumble | 55/166 |
| 2,593,729 | 4/1952 | Coberly | 103/46 |
| 2,765,850 | 10/1956 | Allen | 166/267 |
| 2,942,552 | 6/1960 | Wayt | 417/390 |
| 4,330,306 | 5/1982 | Salant | 55/159 |
| 4,410,041 | 10/1983 | Davies et al. | 166/372 |

*Primary Examiner*—Bernard Nozick

[57] ABSTRACT

Method and means to pump a well with a hydraulically-driven downhole pump (15) as powered by a hydraulic surface unit (1) are disclosed, including a downhole filter assembly (71) and a flowline mounted oil leach (27) for supplying makeup oil to the surface unit.

9 Claims, 2 Drawing Sheets

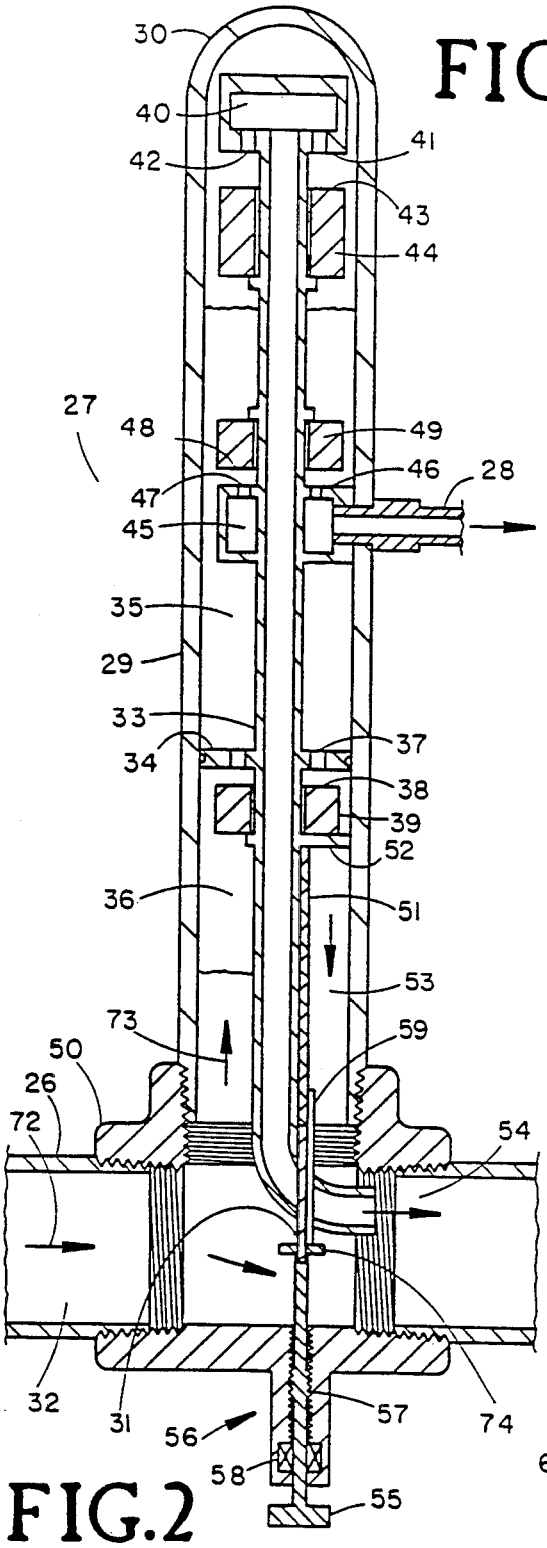
FIG.2
FIG.3
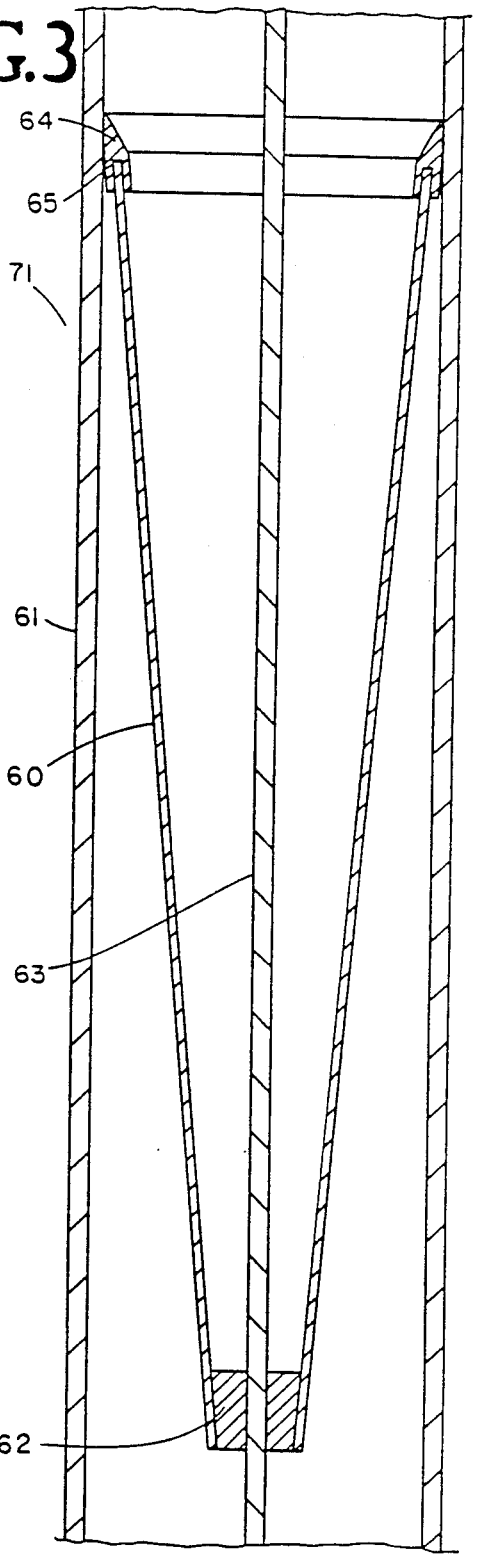

METHOD AND MEANS TO PUMP A WELL

TECHNICAL FIELD

This invention relates generally to methods and means for pumping oil and water from deep wells and more particularly to the use of hydraulically-driven pumps. Although fluid power has long been used to drive such pumps, severe difficulties still exist in the pumps now available such as sand cutting, sand fouling, excessive use of energy, excessive downtime and excessive maintenance.

Although the use of sucker rods to operate a downhole reciprocating pump is the oldest and most widespread methods, the well known high first cost and endless maintenance problems inherent in sucker rod systems have almost become accepted by many operators as inevitable which, unfortunately, drives up the cost of oil and gas and many "crooked holes" cannot be pumped at all with the use of sucker rods. The practice of "gaslifting" liquids from wells by injecting pressurized gas into a column of liquid within a tubing is well known to be an inefficient system when compressors are required to compress the gas before injection, and it cannot be used at all in most deep wells of today.

Downhole hydraulic pumps have been used since 1935, but are used in less than 1% of pumping wells today because of excessive cost and excessive maintenance. Typical recommendation is to change the pump every two months.

Therefore, particularly with regard to such wells as offshore wells which are generally both deep and directionally drilled, when the pressure of their producing formation declines such that they will not longer flow on their own, a more reliable and efficient method and means for pumping is needed by the industry to gain many millions of barrels of oil and billions of cubic feet of gas, as the present invention provides.

In many oilwells, paraffin that may be present in the formation oil may precipitate from the oil as it nears the surface and deposit on the walls of the conduit and thereby reduce the flow area to make remedial action necessary which may result in considerable expense and lost production.

BACKGROUND ART

U.S. Pat. Nos. 2,362,777 and 3,123,007 disclose early systems for hydraulically driving a reciprocating well pump but neither have bearing on the present invention. Many similar patents exist, some having fluid motors for attachment to conventional pumps or to operate a string of sucker rods which in turn operate a conventional downhole pump.

Coberly U.S. Pat. No. 2,952,212, the type pump that virtually all downhole hydraulically driven pumps in use today comprise, operates by co-mingling spent power fluid with produced liquid from the well which requires separation and purification of all of the power fluid before recirculation to the downhole pump. A later Coberly U.S. Pat. No. 3,005,414, employs a power fluid string and a separate conduit to return exhaust power fluid to the surface and a production string to convey produced liquid to the wellhead as does the present invention. However, frequent clogging of small flow paths in that type of pump by solids entrained in the power fluid, require frequent placement of the pump.

As with all hydraulic equipment, some leakage may occur at moving seals, at pipe fittings or the like such that makeup fluid is required to replace such leakage so as to allow for continuous operation of the system. The open system described by Coberly causes co-mingling of the exhaust power fluid with the produced well fluid which in many wells may be mostly water, thereby requiring a production separator to process the entire stream of produced fluid mixed with exhausted power fluid so as to make available power fluid for continued operation. A closed system does not mingle produced fluid with exhausted power fluid and therefore, it is not required to separate the two for each cycle of the fluid, however, makeup fluid is required by the system to offset aforementioned leakage. Makeup fluid for a closed hydraulic system is usually provided by the operator keeping track of oil level in the tank and periodically delivering oil to inject into the system. Unattended operations in the field can thereby be jeopardized by any delay of that service. It is therefore desirable to prevent the need for and cost of separating all power fluid for each cycle and to have makeup power fluid automatically supplied to the system without the need for extended supply lines from distant tanks and/or treatment facilities, or the manual replenishment of oil to the system.

Presley U.S. Pat. No. 4,233,154 discloses a production separator, normally mounted a considerable distance from the wellhead and in some cases miles from the wellhead, that makes provision to pump fluid back to the well for driving a downhole pump in an open system as taught by Coberly U.S. Pat. No. 2,952,212. No prior art known to the inventor provides for a downhole filter so as to exclude particles, within the power conduit being used to convey pressurized fluid downwardly to the pump motor, from entering the pump motor; automatically provides at the wellhead, for the proper volume of makeup fluid to offset leakage from a closed system; prevents precipitation of paraffin from the well fluid by heating power fluid used to drive a downhole pump; eliminates the hydrostatic pressure differential across the wall of the conduit used to convey pressurized power fluid. Such omissions may partially explain the extremely limited application to date of hydraulically driven downhole pumps.

DISCLOSURE OF INVENTION

The present invention provides for method and means to sufficiently clean hydraulic fluid in a closed system used to drive a downhole well pump and to automatically make up, at or near the wellhead, for power fluid lost from the system. One or more filter elements are positioned in a joint of tubing mounted immediately above the downhole pump so as to exclude from the pump, solid particles that may be in the supply or return tubing conveying power fluid to or from the pump. As depicted, the filter elements comprise conically formed filter screens, supported at a lower section near the apex of the cone against downward movement by an axially disposed tension member attached at an upper end above the screen with the tubing wall within which the screens are mounted. An upper section of the screen, being of maximum diameter, is mounted with an inner surface of the tubing so as to direct all fluid flow through the screen.

A device much smaller than a production separator is mounted with the flow line near the wellhead so as to receive a small portion of the fluid produced from the well, separate an amount of oil therefrom sufficient to offset leakage from the closed system, such that the system may continue to operate unattended and without the necessity to periodically furnish oil to the system by other means.

Tubing connections are provided so as to improve in combination, improved clearance, axial strength and sealability, arranged in a concentric pattern with a conduit for conveying pressurized power fluid at the center within a conduit for conveying exhaust fluid back to the wellhead, such that the hydrostatic pressure across the wall of the centermost conduit is balanced.

The pressurized power oil being pumped downwardly to drive the bottom hole pump may be heated at the surface so as to prevent precipitation of paraffin from the well fluid and thereby prevent reduction of the flow area of the conduct conveying well fluid to the wellhead.

BRIEF DESCRIPTION OF THE DRAWINGS

FIG. 2 depicts a small separator or "leach" for separating a minor portion of oil from a flow line.

FIG. 3 is a vertical section of a filter screen in accord with the present invention.

DETAILED DESCRIPTION OF THE INVENTION

Figure 1:
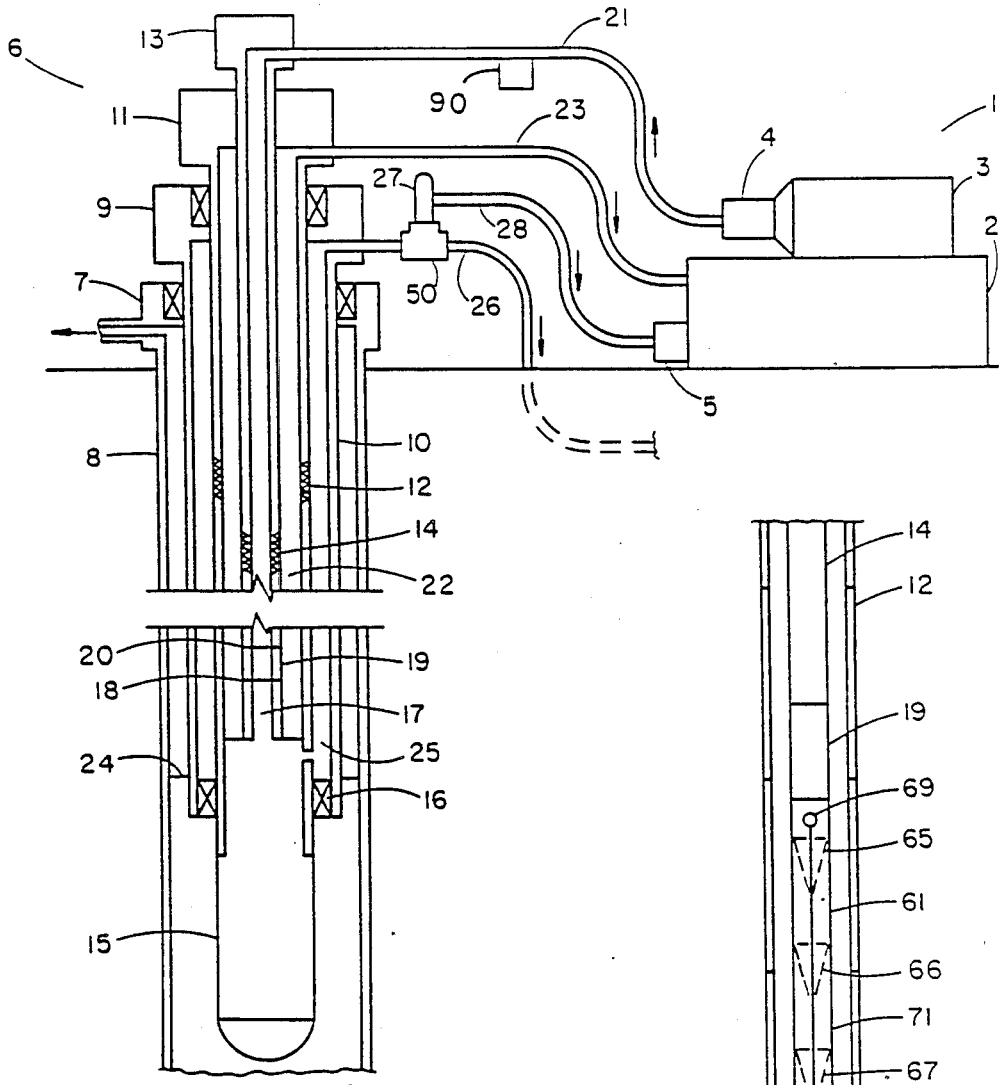
FIG. 1 depicts a general arrangement of means that may be used to practice this present invention.

FIG. 1 depicts a surface-mounted source of hydraulic power henceforth called the surface unit, shown generally at 1 comprising: tank 2, motor 3, pump 4 and float valve 5, motor 3 being of whatever type most convenient for each well location. The wellhead shown generally at 6 may comprise: casing head 7 mounted with casing string 8 and in communication therewith; tubing head 9 mounted with production tubing string 10 and in communication therewith; tubing head 11 mounted with return tubing string 12 and in communication therewith; tubing head 13 mounted with power tubing string 14 and in communication therewith. Pump 15 may be installed with return string 12, positioned on the lower end thereof and sealed as at 16 with the lower portion of production string 10 through which it is inserted, in any suitable manner. Filter joint 17 may be mounted with and immediately above pump 15 so as to filter all power fluid flowing to the pump immediately before the power fluid enters the pump so as to exclude all solid particles entrained with power fluid that may otherwise damage or clog the pump. A lower member 18 of remotely actuated tubing connector 19, may be connected with the upper portion of filter joint 17 so as to allow connection with upper member 20 of connection 19 mounted with the lower portion of power string 14 after power string 14 is inserted into and lowered through return string 12 to mate members 18 and 20. Pressured power fluid may then be conveyed from pump 4 through conduit 21, through head 13, downwardly through power string 14, through connection 19, through filter joint 17 and thence to drive pump 15. Exhaust power fluid from pump 15 may return upwardly through annulus 22 formed between strings 12 and 14 through head 11 and conduit 23 for return to tank 2.

Well fluid within which pump 15 may be immersed as at 24, may be produced upwardly through annulus 25 formed between strings 10 and 12, through head 9 and thence through flowline 26 to surface treatment facilities and thence to storage tanks or pipeline.

Flash-joint connectors for some or all of the tubing strings 10, 12 and 14 may be used so as to provide conduits within the space available in typical oilwells and to provide tubing joints having adequate axial strength and sealing capability.

So as to provide makeup power fluid that may have leaked from the system, leach 27 to be later described, may be connected with an upper opening in the flowline 26 as with tee 50, so as to supply makeup fluid via conduit 28 to conventional float valve 5 such that float valve 5 will admit makeup fluid from conduit 28 to within tank 2 to thereby maintain fluid level within tank 2 within desired limits.

Now referring to FIG. 2, leach 27 may comprise: tubular shell 29 sealingly affixed with an upwardly positioned outlet of tee 50 and enclosed at an upper extremity as at 30; flow restrictor 31 mounted in flow path 32 of flowline 26 so as to create a differential fluid pressure across flow restrictor 31 sufficient for purposes later described, while allowing the vast majority of the volume of flow within the flowline to pass under the restrictor together with solids that may be entrained so as to maintain the leach as self-cleaning; gas conduit 33 extending from an upper portion of shell 29 to a position within flowpath 32 downstream of restrictor 31 may be of sufficient capacity so as to vent gas that may collect in the upper portion of shell 29, the differential created across restrictor 31 being sufficient to exceed the hydrostatic pressure differential then existing between the inlet and outlet of conduit 33; radially positioned wall 34 formed in a lower portion of shell 29 and around conduit 33 so as to divide shell 29 into upper chamber 35 and lower chamber 36, wall 34 being formed with openings as at 37 formed therethrough for cooperation with upper surface 38 of water shutoff valve 39 mounted therebelow so as to seal openings 37 to prevent the flow of water therethrough; chamber 40 formed within upper portion of conduit 33 in communication therewith having downwardly facing wall 41 formed with openings as at 42 therethrough for cooperation with an upper surface 43 of oil shutoff valve 44 so as to prevent oil from entering conduit 33; oil chamber 45 formed within shell 29 intermediate valve 44 and wall 37 having an upper wall 46 formed with openings as at 47 therethrough for cooperation with a lower surfce 48 of gas shutoff valve 49 mounted above wall 46 so as to seal openings 47 and thereby prevent the flow of gas therethrough; conduit connected so as to convey oil from chamber 45 to float valve 5 of FIG. 1; membrane 51 attached with an upper portion of restrictor 31 and extending upwardly to wall 52 extending from the downstream side of the lower chamber so as to form water chamber 53 open at a lower extremity to flowpath 32 downstream of restrictor 31.

Water shutoff valve 39 may be formed of suitable material and dimensioned so as to float in water and to sink in oil such that should water rise within shell 29 to approach wall 34, valve 39 will rise and seal openings 37 so as to prevent the flow of water therethrough and when water is at a lower level, oil and gas may rise through openings 37 to entire upper chamber 35.

Oil shutoff valve 44 may be formed of suitable material and dimensioned so as to float in oil and to sink in gas such that should oil rise within shell 29 to approach wall 41, valve 44 will rise and seal openings 42 so as to prevent the flow of oil therethrough and when oil is at a lower level, gas may pass through openings 42 into conduit 33 and thence re-enter flowpath 32 as at 54.

Gas shutoff valve 49 may be formed of suitable materials and dimensioned so as to float in oil and to sink in gas such that should the oil level falls within shell 29 to approach wall 46, valve 49 will descend and seal openings 47 so as to prevent the flow of gas therethrough and when oil is at a higher level, oil may pass through openings 47 into oil chamber 45 and thence through conduit 28 and to tank 2 as regulated by float valve 5.

Should it be desirable in some applications, restriction 31 may be adjustable as by providing gate valve stem 55 mounted within hub 56 formed with tee 50 by means of screw threads 57 and sealed as by packing 58 around stem 55 so as to allow rotation and axial movement of stem 55 without leakage from flowpath 32. Restrictor 31 may be formed with a conventional tee slot to fit radial flange 74 formed on the end of stem 55 so as to allow stem 55 to push and pull on restrictor 31 which may be slidably mounted as the gate of a conventional gate valve. So as to prevent unwanted flow above restrictor 31, plate 59 may be affixed so as to overlap membrane 51 and restrictor 31 over the full range of adjustment of the restrictor.

Now referring to FIG. 3, a filter assembly shown generally at 71 may comprise a suitable filter material formed as the frustrum of a cone as at 60 mounted within tubular filter joint 61 and supported by any suitable attachment as at 62 with tension member 63. Tension member 63 may be attached with an upper portion of filter joint 61 in any suitable manner as by a bar 69 of FIG. 4 positioned across the inner diameter of filter joint 61 and having threaded ends for mating with a portion of internal threads formed in the upper portion of the filter joint. The upper and larger end of cone 60 may be mounted with member 64 formed of elastomer or the like so as to prevent fluid flow around the upper periphery 65 of cone 60 so as to direct all flow through filter joint 61 to be filtered through cone 60.

Figure 4:
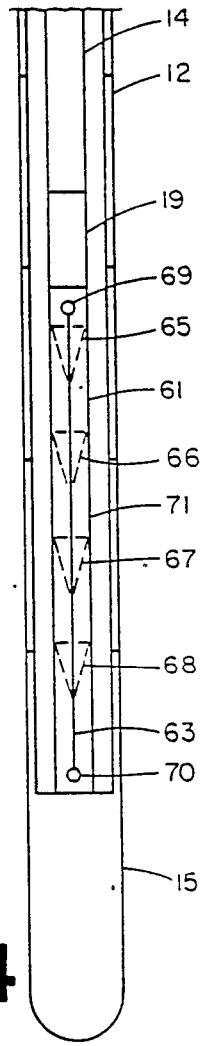
FIG. 4 depicts a preferred position for the downhole filter of the present invention.

FIG. 4 depicts a series of cones 65, 66, 67, and 68, attached to tension member 63 and mounted within filter joint 61 as previously described for the purpose of extending the usable life of the filter assembly. For example, if it was desired to prevent particles larger then ten microns from entering pump 15 and scale within strings 12 and 14 constituted particles ranging from 10 to 500 microns, a single fine filter would become prematurely clogged with large particles whereas a single course filter would pass particles that would damage pump 15. Therefore, it may be desirable to make; cone 65 to filter 400 micron particles; cone 66 to filter 200 micron particles; cone 67 to filter 100 micron particles, and cone 68 to filter 50 micron particles. A lower end of tension member 63 may be fastened at 70 as desribed at 69 to secure the assembly during handling and shipment. So as to be able to run economically feasible sizes of tubing for power string 14 and return string 12 and still provide for flow paths having adequate cross sections so as to allow passage of power fluid within practical limits of pressure drop, flush joint tubing joints may be used therefor.

Should the well fluid flowing upwardly toward the wellhead be of low enough temperatures to cause precipitation of paraffin that may be a part of the well fluid, oil heater 90 may be connected so as to heat power oil flowing to the well so as to transfer sufficient heat through the tubing walls as required to prevent said precipitation.

Operation of the invention may now be understood. After installation of casing string 8, head 7, production tubing string 10 and head 9 in a conventional manner, pump 15, filter joint 17 and lower member 18 of remotely actuated connector 19 may be sealably connected together in the order shown by FIG. 1. Pump 15 may then be sealably connected to the lower end of return string 12 for insertion downwardly into string 10 so as to connect and lower all joints of string 12. Pump 15 may then be sealably connected with the lower portion of string 10 by any suitable means. String 12 may then be mounted with head 11 in a conventional manner. Any solid particles such as sand, pipe scale, or such that may fall down within string 14 during or after installation of string 14 will fall into the annulus between string 14 and filter joint 17 or be stopped by filter screens 65–68 so as to preclude such particles from pump 15 during installation. Upper member 20 may now be sealably mounted with the lower end of power tubing string 14 which may then be inserted into and run downwardly into string 12 so as to connect member 20 with member 18 and thereby effect a conduit for delivery of high pressure power fluid to pump 15. String 14 may then be mounted with head 13 in a conventional manner so as to complete the downhole circulation system. An outlet of head 7 may be connected with a gas line so as to receive gas from the formation upwardly through the annulus between strings 8 and 10 and an outlet of head 9 may be connected with flowline 26 so as to receive fluid being pumped by pump 15 upwardly through annulus 25. Conduits 21, 23 and 28 may then be connected with surface unit 1 positioned as desired from the wellhead perhaps 20 feet and as depicted and previously described. A clean power fluid such as filtered crude oil may then be supplied to tank 2 in sufficient quantity to fill tank 2, conduits 21 and 23, tubing strings 12 and 14, being pumped around by surface pump 4 driven by motor 3. Continued pumping by pump 4 will begin operation of pump 15 which will pump well fluid upwardly through annulus 25 and thence through flowline 26 to heaters, treaters, separators and storage tanks or pipelines. all at considerable distance from the wellhead, from hundreds of feet and often miles.

A conventional filter may be provided with surface unit 1 to remove particles larger than 10 microns from the power fluid before the fluid enters pump 4, however, as pressurized power fluid flows through conduit 21 and power tubing string 14, scale, sand and such may precipitate from within conduit 21 and string 14 that could cause damage to pump 15. Therefore, as the power fluid flows downwardly through filter joint 17, cones 65, 66, 67, and 68, successively filter smaller particles from the flowstream to thereby protect pump 15 from damage by the particles in a manner to effect extended service life of the filter assembly. Particles precipitating into the power fluid flowstream from within string 14, if finer than can be filtered by cone 68, will pass through pump 15 only one time, to be filtered at surface with 1 whose conventional filters may be changed as required without removing string 14 from the well. The filter materials of cone 68 were selected to retain particles larger than 50 microns, such particles once through should cause no appreciable wear to pump 15 and the useful life of the downhole filter system should be adequate.

As the well fluid enters tee 50 as at arrow 72, a minute upper portion of the lighter fluids will tend to stagnate upstream of restrictor 31 and rise into lower chamber 36 as at 73, while the vast majority of the fluid and all sediments will flow under restrictor 31 to continue along flowline 26 and thereby create a fluid pressure differential across restrictor 31, sufficiently greater than the pressure differential existing between the uppermost portion of chamber 35 and the lowermost portion of chamber 36 so as to cause gas to flow downwardly through conduit 33. Should a pressure differential adjustment be provided, stem 55 may be rotated so as to cause an optimum pressure differential to operate the leach.

As a mixture of oil and gas rise in chamber 36, residual water, separating by gravity from the mixture, will fall and flow under the restrictor residual water may flow therethrough due to the differential pressure. Should water rise to approach wall 34 as could happen on startup, valve 39 will rise and prevent further upward flow until the water is replaced with accumulated oil, upon which, valve 39 will fall so as to allow oil and gas to rise through openings 37 into chamber 35. Gas passing upwardly within chamber 35 will pass around oil chamber 45 toward the upper portion of chamber 35 and thence through openings 42 into conduit 33 so as to re-enter flowstream 32 as at 54. Should oil rise in chamber 35 to approach wall 41, valve 44 will rise and prevent flow of oil into openings 42, however, should accumulated gas within chamber 35 push the oil level back down, valve 44 will fall to once again purge the gas. Should the oil level within chamber 35 drop to approach wall 46, valve 49 will fall and prevent gas from entering conduit 28 via openings 47 and chamber 45, however, as the oil level again rises, valve 49 will rise to allow the flow of oil to tank 2 as regulated by float valve 5 so as to maintain the oil level within tank 5 at a desired level. It is therefore clear that the present invention may provide adequate makeup oil automatically to the surface unit so as to allow continuous unattended operations thereof.

I claim:

1. A method for automatically supplying makeup oil to a hydraulic pumping system used for pumping an oil well that produces a fluid mixture such as oil-water-gas-entrained solid particles into a flowline, comprising: mounting a pressure vessel to be in communication with the flowline so as to receive at least some of the produced fluid into the pressure vessel through a supply conduit; the vessel being of sufficient form and dimension so as to allow the fluids to separate by gravity; venting oil from the vessel through an oil conduit to the pumping system as needed for make-up; venting other fluids through a vessel outlet so as to continue downstream within the flowline; mounting a flow restrictor within the flowpath of the fluid between the supply conduit and the outlet; the restrictor being of sufficient form and dimension to reduce the cross-sectional area of the flowpath as required to maintain the fluid pressure upstream of the restrictor greater than the fluid pressure downstream of the restrictor such that gas may readily flow from an upper section of the vessel through a gas conduit and re-enter the flowline downstream of the restrictor.

2. The method of claim 1 wherein: the vessel outlet is positioned at the lower extremity of the vessel so as to pass solid particles to return to the flowline and thereby maintain the vessel as self cleaning.

3. The method of claim 1, further comprising: one or more float valves mounted with the vessel so as to admit oil from the vessel to enter the oil conduit; so as to exclude separated gas and water from the oil conduit.

4. The method of claim 1, further comprising: a float valve mounted with an upper section of the vessel so as to vent gas but not liquid from the vessel.

5. The method of claim 1, further comprising: means within a lower section of the vessel to prevent the upward movement of free water but will allow upward movement of fluids of lighter density than water.

6. The method of claim 1, further comprising: means within an upper section of the vessel to allow upper passage of gas but not liquid.

7. The method of claim 1 wherein: the flow restrictor is formed and positioned to reduce the cross-sectional area of the flowpath so as to allow solid particles to flow past the restrictor and thereby prevent buildup of solid particles upstream of the restrictor to thereby maintain the restrictor as self cleaning.

8. The method of claim 1 or 7 wherein: the restrictor forms a wall across an upper portion of the flowpath so as to allow the entrained solid particles to flow under and past the restrictor.

9. The method of claim 1 or 7 wherein: the restrictor is made to be adjustable by any conventional means so as to allow for the adjustment of the downstream pressure during operation of the restrictor.

* * * * *